US009308431B2

(12) United States Patent
Tiitola

(10) Patent No.: US 9,308,431 B2
(45) Date of Patent: Apr. 12, 2016

(54) SKI

(71) Applicant: Antti-Jussi Tiitola, Kaivanto (FI)

(72) Inventor: Antti-Jussi Tiitola, Kaivanto (FI)

(73) Assignee: REAKTIIVI KY (FI)

( * ) Notice: Subject to any disclaimer, the term of this patent is extended or adjusted under 35 U.S.C. 154(b) by 13 days.

(21) Appl. No.: 14/604,784

(22) Filed: Jan. 26, 2015

(65) Prior Publication Data

US 2015/0209648 A1 Jul. 30, 2015

(30) Foreign Application Priority Data

Sep. 19, 2014 (FI) ..... 20140011 U

(51) Int. Cl.

| | |
|---|---|
| ***A63C 7/00*** | (2006.01) |
| ***A63C 7/02*** | (2006.01) |
| ***A63C 7/04*** | (2006.01) |
| ***A63C 5/044*** | (2006.01) |
| ***A63C 5/056*** | (2006.01) |

(52) U.S. Cl.

CPC ..... *A63C 5/044* (2013.01); *A63C 5/056* (2013.01); *A63C 7/04* (2013.01)

(58) Field of Classification Search

CPC ..... A63C 7/00; A63C 7/02; A63C 7/04; A63C 7/08; A63C 5/00

USPC ..... 280/604

See application file for complete search history.

(56) References Cited

U.S. PATENT DOCUMENTS

| | | | | | |
|---|---|---|---|---|---|
| 2,184,791 | A | * | 12/1939 | Broome | 280/610 |
| 4,564,210 | A | * | 1/1986 | Case | 280/604 |
| 4,844,500 | A | * | 7/1989 | Fischer | 280/604 |
| 5,221,104 | A | * | 6/1993 | Bejean et al. | 280/604 |
| 5,344,177 | A | * | 9/1994 | Rouser et al. | 280/610 |

* cited by examiner

*Primary Examiner* — Bryan Evans

(74) *Attorney, Agent, or Firm* — Galbreath Law Offices, P.C.; John A. Galbreath

(57) ABSTRACT

A ski (s) equipped with on a base of said ski mounted skin preventing gliding backwards of said ski, said base material being of plastic at least in the gliding portion, wherein said skin being placed on the base of the ski (s) in a recess (c) said recess being formed essentially in the middle portion of said base. The base of said ski (s), including said recess (c), is formed of uniform plastic layer (h).

6 Claims, 1 Drawing Sheet

A – A

B – B

C – C

D - D

SKI

BACKGROUND OF THE INVENTION

The invention relates a ski equipped with on a base of said ski mounted skin preventing gliding backwards of said ski, said base material being of plastic at least in the gliding portion, whereby said skin being placed on the base of the ski in a recess said recess being formed essentially in the middle portion of said base. In the ski base integrated skins have been used since hundreds of years. Mostly seal skins have been historically used.

DESCRIPTION OF THE RELATED TECHNOLOGY

Nowadays in the modern ski types in mountain use so called climbing skins which have been manufactured by textile techniques have been used. These skins are fitted in the ski base either via mechanical fittings or Velcro fitting when climbing on the mountain. On the mountain top the skins are loosened from the skis and packaged in the bag wherein the slope can be sled by means of gliding bases.

Nowadays it has been easygoing to elect a base plastic for a ski which is made of plate-like Polythene whose thickness is also elected so that when this plate-like base plastic is not mounted on the area intended for the base skin there is then formed suitable recess for mounting the skin. The ski has been also equipped with edges made of steel which edges protect the skin of its edges against wearing and tear. This kind of ski looks like alpine ski of its structure, except that the skin has been mounted in the middle area of the base formed recess having depth corresponding the thickness of the base plastic.

SUMMARY OF CERTAIN INVENTIVE EMBODIMENTS

In the ski according to present invention the fixedly mounted climbing skin has been embedded and permanently fixed in the base of the ski and embedded into such a depth that the skin, when sliding along furs forward as little as possible hinders the slide, but against furs backwards during kick effectively hinders sliding backwards.

When the main use of the ski according to invention is not alpine skiing but primarily to replace use of the snowshoes when moved in snow cover terrain, the skin based skis become too expensive manufactured by means of above described method and structure and also they have some unnecessary features.

In the skis according to invention the construction of the ski has been made simpler so, that separate gliding base of polythene plastic and the edges of steel have been left out. Instead of them the base has been shaped so that when the base is infused in a mould a recess is formed for the climbing skin in said base as well as edge rails to protect the climbing skin from the side. The gliding base itself is formed of fibre reinforced thermoplastic or thermoset plastic (Epoxy, Polyester or Polyurethane), which base is also to of its surface layer reinforced by means of thin synthetic fibre manufactured nonwoven fabric layer. This coating produced in connection of the manufacturing of the skis extends as a uniform coating in the whole base area, as in the gliding areas, edge rails as in the recess of the climbing skin. By means of combination of nonwoven fabric and thermo-setting resin excellent mechanical wearing resistance and thanks to smoothness of the surface good slide in all snow type can be achieved.

DETAILED DESCRIPTION OF CERTAIN INVENTIVE EMBODIMENTS

Figure 1:
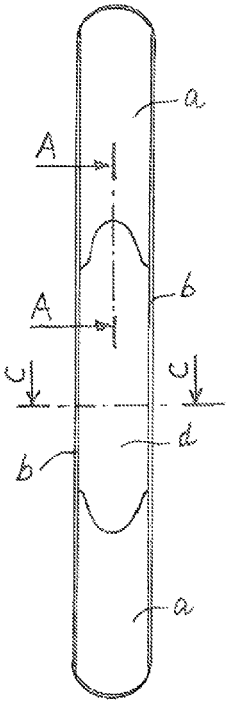
FIG. 1 PRIOR ART
FIG. 1 shows a ski according to prior art seen from base.
Figure 4:
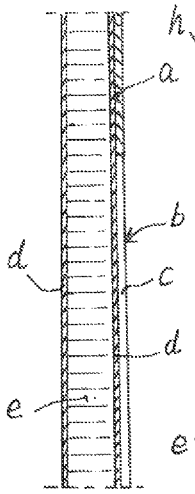
FIG. 4 PRIOR ART
FIG. 4 shows a section view A-A of a ski according to FIG. 1.
Figure 6:
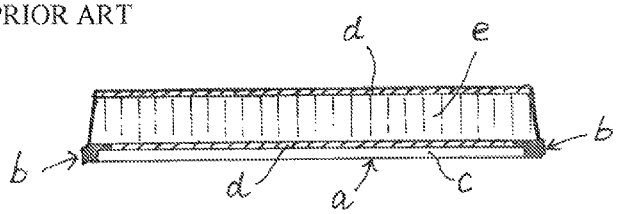
FIG. 6 PRIOR ART
FIG. 6 shows a section view C-C of a ski according to FIG. 1.

FIGS. 1, 4 and 6 shows how in a traditionally manufactured ski the depth of a recess c intended to a climbing skin s is formed to correspond the thickness of the base plastic a and the steel edges b. The body material layer e is placed between the surface plastic d and base plastic a.

Figure 2:
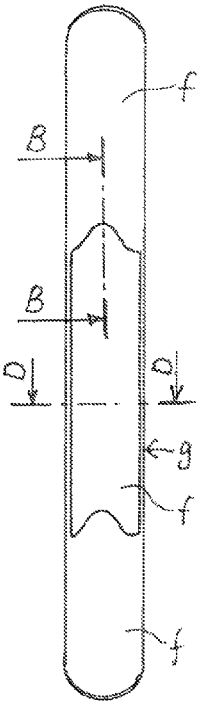
FIG. 2 shows a ski according to the invention seen from base.
Figure 3:
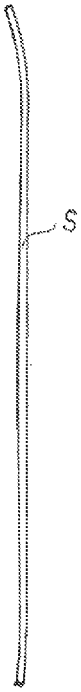
FIG. 3 shows a ski (FIGS. 1 and 2) from the side.
Figure 5:
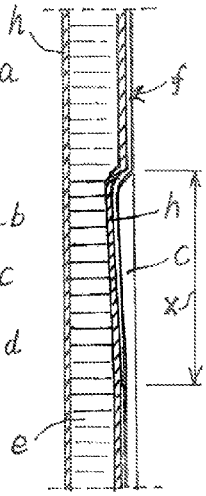
FIG. 5 shows a section view B-B of a ski according to FIG. 2.
Figure 7:
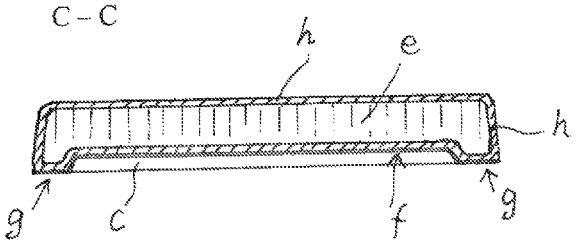
FIG. 7 shows a section view D-D of a ski according to FIG. 2.

FIGS. 2, 5 and 7 shows how in a ski according to the invention the recess c intended for the climbing skin is formed by infusing thermoset plastic or moulding thermoplastic in the mould so, that the surface structure h, f of the base extends seamless from the gliding area to the recess c intended for the climbing skin as well as to area of the edge rails g. In the front portion of the recess c the depth of the recess increases along a distance x which is about 5-10 cm to the depth which is 1.3-2 times deeper than the average depth along the recess c.

The invention claimed is:

1. A ski (s) comprising a body layer (e) and a base, wherein the ski is equipped with a skin mounted on the base of said ski, said skin preventing gliding backwards of said ski, said base material being of plastic at least in the gliding portion, wherein said skin being placed on the base of the ski (s) in a recess (c), said recess being formed essentially in the middle portion of said base, characterized in that the base of said ski (s), comprises a surface structure (f) layer covering the base and said surface structure layer is adapted to extend as seamless and uniform from the gliding portion of the base to the recess (c) intended for the skin.

2. A ski (s) according to claim 1, characterized in that the base material is plastic, thermoset plastic or thermoplastic.

3. A ski (s) according to claim 1, characterized in that the recess (c) for the skin is adapted to become deeper when extending forward in the front portion of the recess (c) along the distance (x), wherein the depth of the recess (c) when the depth is as its deepest is about 1.3-2 times deeper than the average depth along the recess (c).

4. A ski (s) according to claim 1, characterized in that base edge comprises rails (g) in the sides of the ski (s), said rails being coated with the surface structure (f) layer.

5. A ski (s) according to claim 1, characterized in that the base of ski (s) further comprises base layer (h) located between the body layer (e) and the surface structure (f) layer.

6. A ski (s) according to claim 1, characterized in that the surface structure (f) layer is of an even thickness.

* * * * *